US008585162B2

(12) United States Patent
Pantoja et al.

(10) Patent No.: US 8,585,162 B2
(45) Date of Patent: Nov. 19, 2013

(54) RECESSED STORAGE COMPARTMENT

(76) Inventors: Tayde Pantoja, Capistrano Beach, CA (US); Jesse Pantoja, Capistrano Beach, CA (US)

( * ) Notice: Subject to any disclaimer, the term of this patent is extended or adjusted under 35 U.S.C. 154(b) by 0 days.

(21) Appl. No.: 13/237,883

(22) Filed: Sep. 20, 2011

(65) Prior Publication Data

US 2012/0068587 A1 Mar. 22, 2012

Related U.S. Application Data

(60) Provisional application No. 61/384,616, filed on Sep. 20, 2010.

(51) Int. Cl.
*A47B 67/02* (2006.01)

(52) U.S. Cl.
USPC ..... 312/242; 312/248; 312/327

(58) Field of Classification Search
USPC ..... 312/242, 245, 248, 330.1, 296, 327, 312/328, 213, 325
See application file for complete search history.

(56) References Cited

U.S. PATENT DOCUMENTS

| | | | | |
|---|---|---|---|---|
| 1,136,071 | A * | 4/1915 | Weiss | 312/348.4 |
| 2,311,968 | A * | 2/1943 | Schallis | 220/478 |
| 2,505,324 | A * | 4/1950 | Hendricks | 220/477 |
| 2,785,036 | A * | 3/1957 | Elsden-King et al. | 312/327 |
| 3,140,136 | A * | 7/1964 | Clark | 312/323 |
| 4,186,978 | A * | 2/1980 | Thomson | 312/321.5 |
| 5,894,931 | A * | 4/1999 | Dunn | 206/555 |
| 6,062,416 | A * | 5/2000 | Smillie | 220/524 |
| 6,179,399 | B1 * | 1/2001 | Brustle et al. | 312/348.4 |
| 6,289,529 | B1 * | 9/2001 | Harvey | 4/605 |
| 6,343,845 | B1 * | 2/2002 | Woodard | 312/248 |
| 6,688,238 | B1 * | 2/2004 | Alexiou | 108/42 |
| 6,898,830 | B1 * | 5/2005 | Acton et al. | 27/2 |
| 2005/0166471 | A1 * | 8/2005 | Allen | 52/58 |
| 2007/0228904 | A1 * | 10/2007 | Williams | 312/327 |
| 2008/0052816 | A1 * | 3/2008 | Gillis | 4/559 |
| 2008/0106094 | A1 * | 5/2008 | Edelmayer | 285/42 |
| 2009/0189404 | A1 * | 7/2009 | Anderson et al. | 296/37.6 |
| 2010/0201238 | A1 * | 8/2010 | Caputo | 312/325 |

* cited by examiner

*Primary Examiner* — Darnell Jayne
*Assistant Examiner* — Andres F Gallego
(74) *Attorney, Agent, or Firm* — Kafantaris Law Offices; Theo Kafantaris

(57) ABSTRACT

A recessed storage compartment is for adding additional space within a showering environment without sacrificing precious shower space. The recessed storage compartment includes a housing, a drawer, and a front panel. The drawer and front panel are attached, creating a compartment for common showering items, and this compartment is completely enclosed within the housing. The storage compartment is recessed within a shower wall and opens with a bottom-hinged opening mechanism, allowing quick and easy access to its contents.

7 Claims, 6 Drawing Sheets

RECESSED STORAGE COMPARTMENT

CROSS-REFERENCE TO RELATED APPLICATIONS

This application claims the benefit of U.S. Provisional Patent Application No. 61/384,616, filed on Sep. 20, 2010, and incorporated herein by reference.

STATEMENT REGARDING FEDERALLY SPONSORED RESEARCH AND DEVELOPMENT

Not Applicable.

FIELD OF THE INVENTION

This invention relates to storage compartments, and more particularly, to a recessed container inside of a shower or bathing environment.

DISCUSSION OF RELATED ART

A bathing environment is generally a private area where individuals can attend to and maintain their own personal hygiene. Bathing environments come in many shapes and sizes. The two most common types are showers and bath tubs. A shower typically provides a standing environment with a running water source, while a bath tub typically provides a sitting or lying environment within a pool of water.

A shower typically consists of an indoor, enclosed, private space where the user can stand under a nozzle, or shower head, that distributes water over their body. This water is then removed from the showering unit with a drain. Showers range in size, from individually sized units to larger ones. In larger units, seats and benches are incorporated for an alternative means of cleaning one's body.

The walls of a bathing environment must be water-resistant due to their frequent exposure to water and moisture. Tile is commonly used in bathrooms and showers to seal the walls from unwanted water leaks. A cement board is typically used as a tile backing board as opposed to drywall or gypsum board because cement boards will not mold, mildew, or physically break down due to the constant presence of moisture. For tile walls, the cement board is nailed or screwed to the wall studs and the tile is then placed vertically onto the cement board.

U.S. Pat. No. 6,289,529 to Harvey on Sep. 18, 2001, describes a shower seat and basket combination where the user can sit on a ledge and store items underneath the ledge in a basket. The basket, hanging underneath the ledge, can be slid outward to access its contents. Furthermore, the basket includes perforations to allow water to drain from the basket. While extra items can be stored within a bathing environment, the basket and seat will take precious space within a showering unit.

U.S. patent application Ser. No. US 2008/0052816 to Gillis on Mar. 16, 2008, describes a shower shelf and storage compartments for common showering items. The invention is designed to fit within a cavity of the shower wall and to provide a means to prevent water from entering the compartments. While the invention provides additional storage space, the compartments are not suited for expelling water, the compartment doors are not convenient when inside of the shower, and the device is further complicated with a heating means for the compartments.

U.S. Pat. No. 6,688,238 to Alexiou on Feb. 10, 2004, describes a shower accessory organizing system where common showering items can be stored. A vertical support is provided with several shelves for storing the items, each shelf having a means for draining water. While this invention provides additional storage capacity inside of a showering environment, the shelves are not recessed and will take up valuable space.

While many showers incorporate ledges and other means for holding soap, shampoo, and other cleaning products, they do not provide a means for providing additional storage without sacrificing additional space within a bathing environment. Therefore, a need exists for an additional storage means inside of the showering area that is convenient, will not sacrifice valuable space, and can remove water from its storage compartment. The present invention accomplishes these objectives.

SUMMARY OF THE INVENTION

The present invention provides a means of storing items inside of a shower or bath. This is accomplished by providing a recessed storage compartment inside of the showering unit. The storage compartment comprises a front panel, drawer, and housing. The storage compartment will be easily accessible and will provide ample space for several items to be stored. The front panel will provide a knob or handle to allow access to the storage compartment.

The storage compartment will be exposed to constant water while the showering unit is in use. As such, the storage compartment must have a means of removing water from its storage compartment. Therefore, the storage drawer and the housing will each be sloped and include drain holes to remove the water from the storage compartment. Furthermore, the front panel may provide a means of preventing water from entering into the storage compartment with a rubber or plastic seal.

The storage compartment will be placed within a recessed portion of the shower wall. As such, the storage compartment will take no additional space within the showing environment and will be flush with the wall. Alternatively, the storage compartment may be placed beneath a seat within the showering unit or other unused location. The storage compartment may be made of fiberglass, acrylic, tempered glass, granite, plastic, or any other suitable material.

The storage compartment will provide a bottom-hinged opening mechanism, allowing access to its contents quickly and easily. The storage compartment may be spring-loaded to force the compartment to close after use. The storage compartment may have a snapping means to ensure the compartment is closed. The storage compartment may also have a locking means to keep its contents safe.

The present invention is a container that provides additional storage means inside of a showering area that is convenient, will not sacrifice valuable space, and can remove water from its storage compartment. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
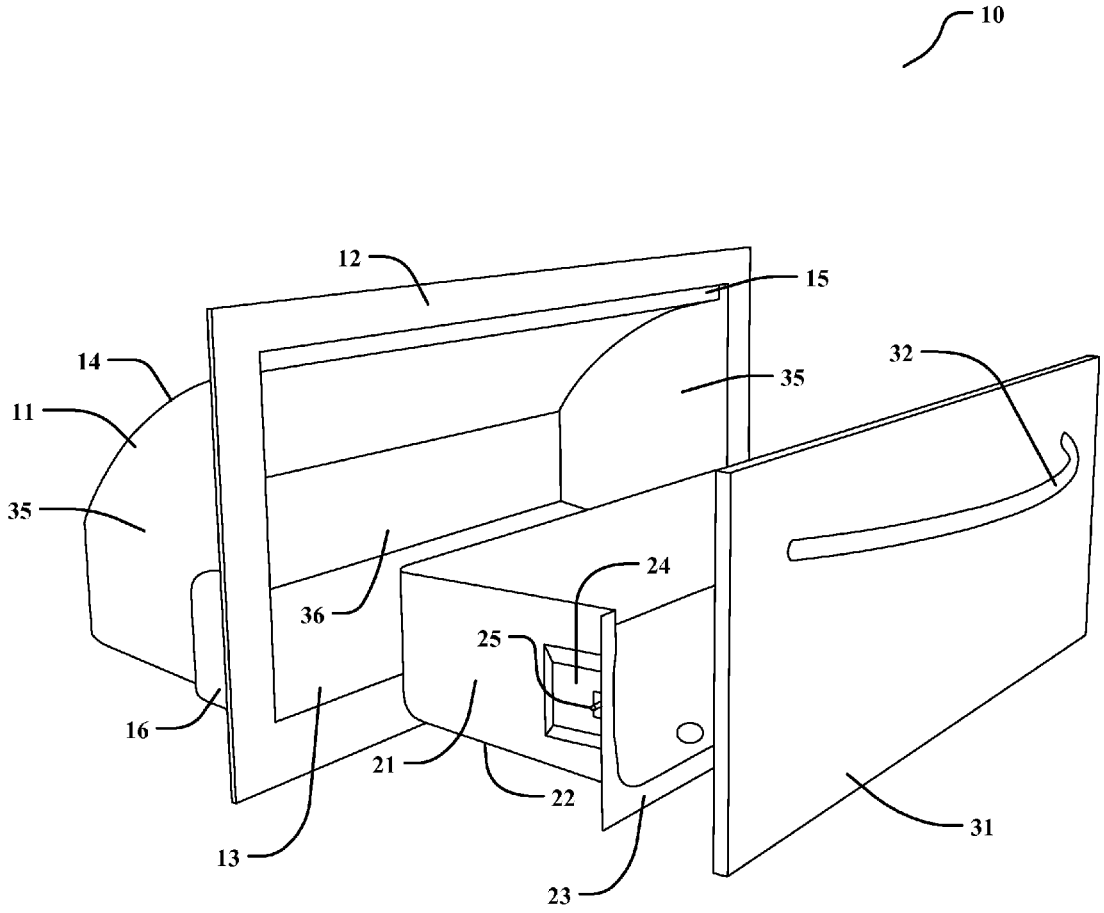
FIG. 1 is a perspective view of the recessed shower container according to one embodiment of the invention.
Figure 2:
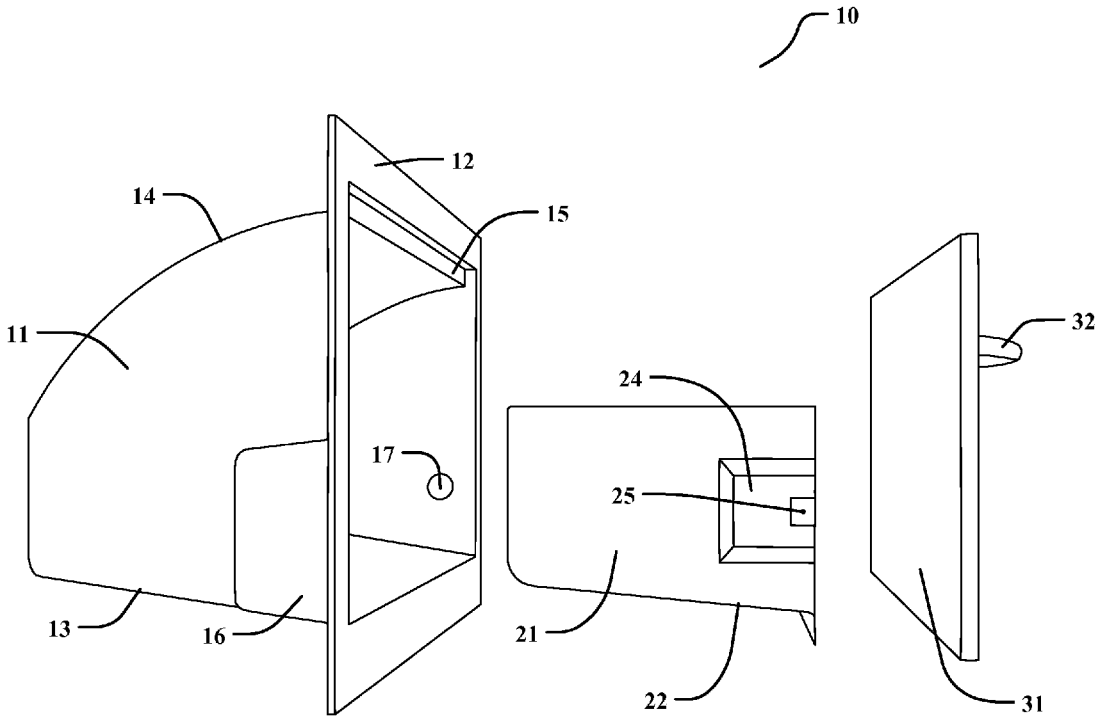
FIG. 2 is a side elevation view of the recessed shower container according to one embodiment of the invention.
Figure 3:
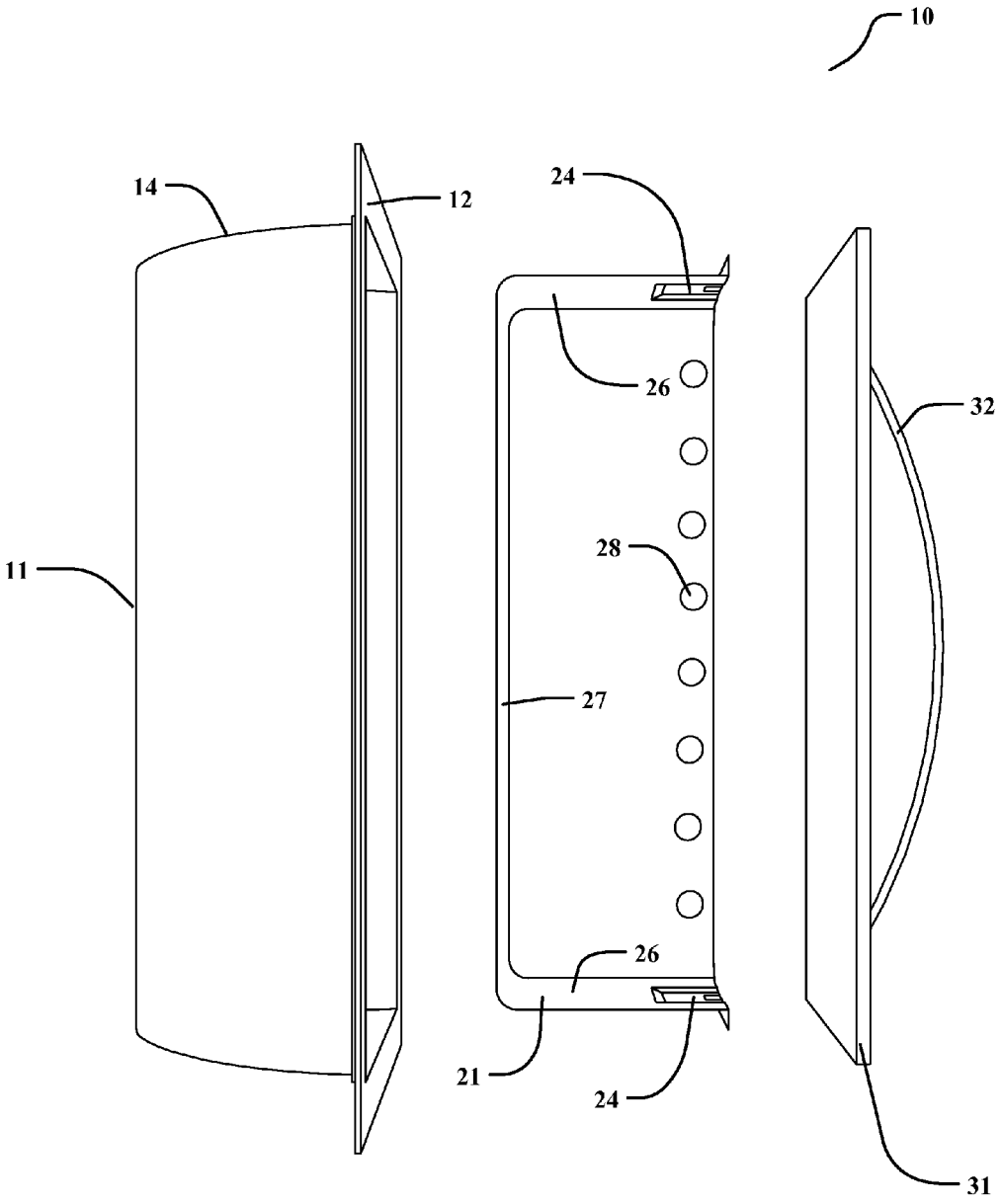
FIG. 3 is a top view of the recessed shower container according to one embodiment of the invention.

FIG. 1 illustrates a new method for adding additional storage to a showering environment. The storage compartment 10 comprises a housing 11, a drawer 21, and a front panel 31. The front panel 31 is fixedly attached to the drawer 21, which is hingably attached to the housing 11. The housing 11 is intended to be recessed within a shower wall, saving valuable space within the showering environment.

The housing 11 is open faced, comprising two opposing side walls 35, a rear wall 36, a floor 13, and a generally curved ceiling 14. The walls 35, 36, floor 13, and ceiling 14 create an enclosed space capable of enclosing the drawer 21. A flange 12 surrounds the entire perimeter of the open face of the housing 11 and extends outward, parallel to the rear wall 36. The floor 13 is sloped downward from the rear wall 36 to the front flange 12 to allow water to drain from the storage compartment 10. A rubber stopper 39 is on the floor near the open face of the housing 11. A pair of opposing housing outward protrusions 16 are positioned on the bottom of each side wall 35 adjacent to the flange 12.

Figure 4:
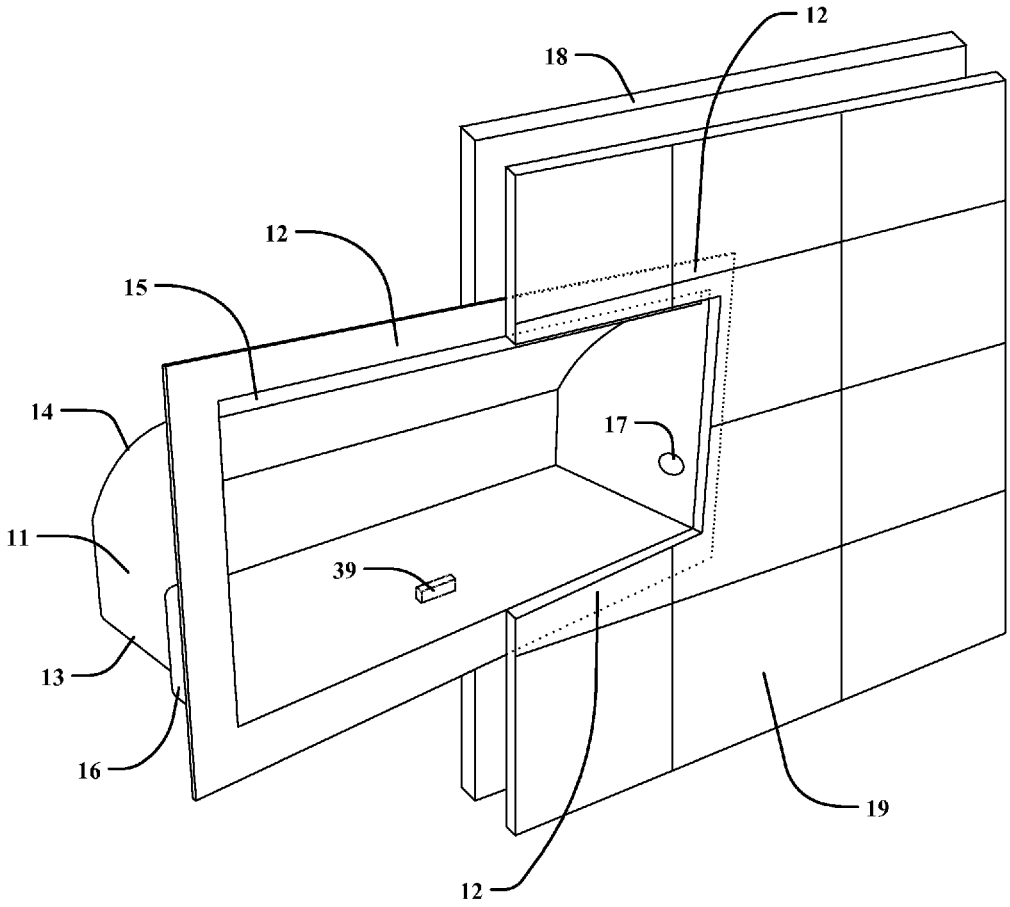
FIG. 4 is a perspective view of the housing installed in a shower wall according to one embodiment of the invention.

FIG. 4 illustrates the storage compartment 10 according to one embodiment. The housing 11 is recessed within a shower wall to save space, and will ideally be installed during bathroom construction. Specifically, the flange 12 is positioned between the cement board 18 and tile 19 of the shower wall. The flange 12 is fastened to the cement board 18 for security, and the tile 19 will be applied afterward to protect the cement board 18 and flange 112, now hidden, from water and moisture.

The drawer 21 is open at its top and front, comprising a pair of opposing side walls 26, a rear wall 27, and floor 22. A flange 23 extends outward from the front of the side walls 26 and floor 22 of the drawer 21 parallel to the rear wall 27. The floor 22 is sloped downward from the rear wall 27 to the front flange 23 to allow water to escape through drain apertures 28 at the front of the drawer 21.

The housing 11 and drawer 21 are each molded individually. The housing 11 will be molded as shown in the figures, while the drawer 21 will be molded in a similar shape as the housing 21, but with the ceiling and additional flanging removed. The housing 11 and drawer 21 may be made of fiberglass, acrylic, tempered glass, granite, plastic, or any other suitable material. The size and placement of the storage compartment 10 will vary depending on the size and available space in the showering unit.

Figure 5:
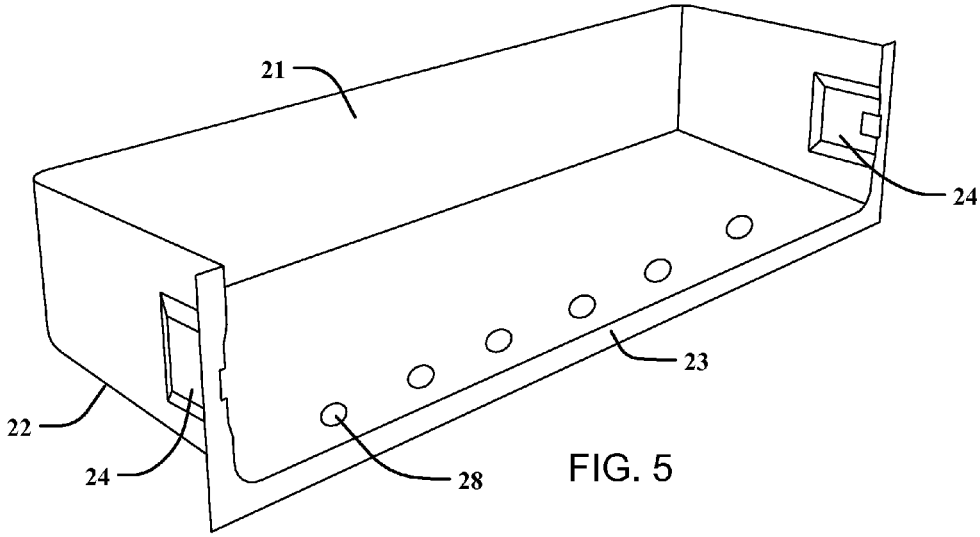
FIG. 5 is a perspective view of the drawer according to one embodiment of the invention.
Figure 6:
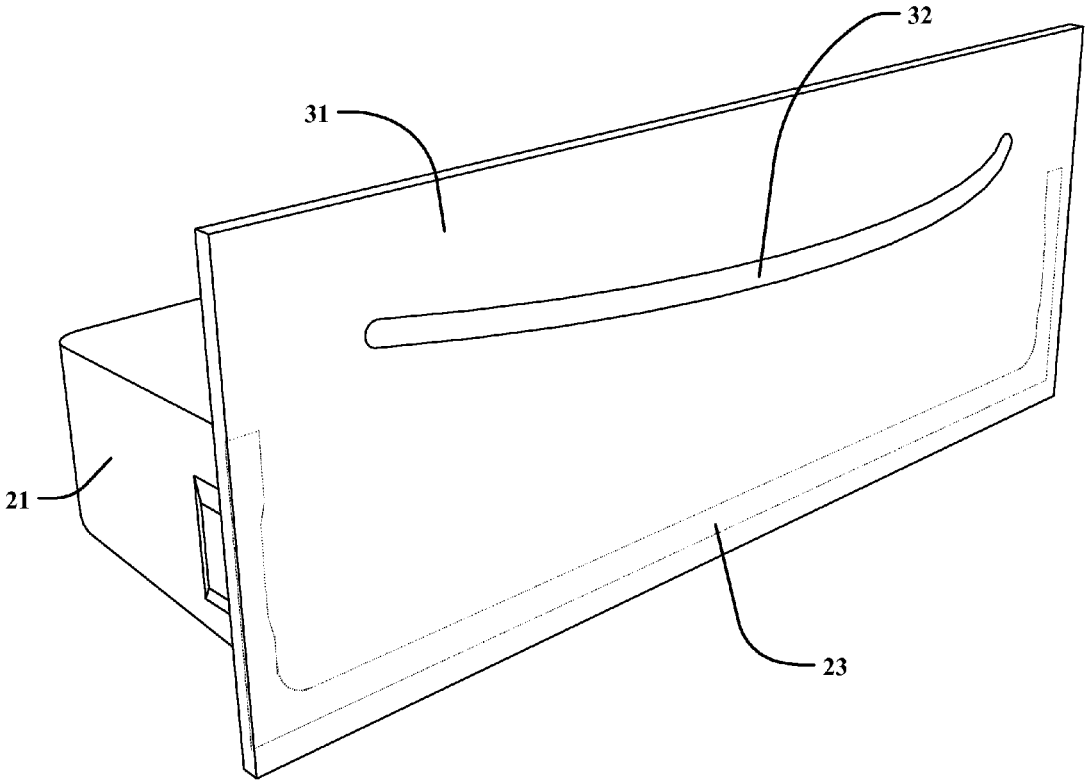
FIG. 6 is a perspective view of the drawer and front panel according to one embodiment of the invention.

The front panel 31 comprises a panel 31 with a fixedly attached handle 32. As shown in FIG. 5, the side of the front panel 31 opposite the handle 32 is fixedly attached to the flange 123 (hidden) of the drawer 21. Once attached, the front panel 31 operates like a front wall for the drawer 21, and along with the side walls 26, rear wall 27, and floor 22, creates a compartment where the user can store commonly used shower items. The drawer 21 may also have several compartments to sort its contents. Furthermore, while a handle 32 is currently illustrated, a knob, groove, indentation, or other gripping means may be used.

The side walls 26 of the drawer 21 comprise outward protrusions 24 with beveled edges on their open sides, the protrusions 24 extending through the flange 23. Each protrusion 24 further comprises a small shaft 25 which extends outward from the side walls 26, parallel to the rear wall 27 and flange 23. The small shafts 25 are pivotally connected to bores 17 on the bottom of each side wall 35 of the housing 11. As such, the drawer 21 is bottom-hinged, allowing access to its contents by simply pulling on the handle 32.

Figure 7:
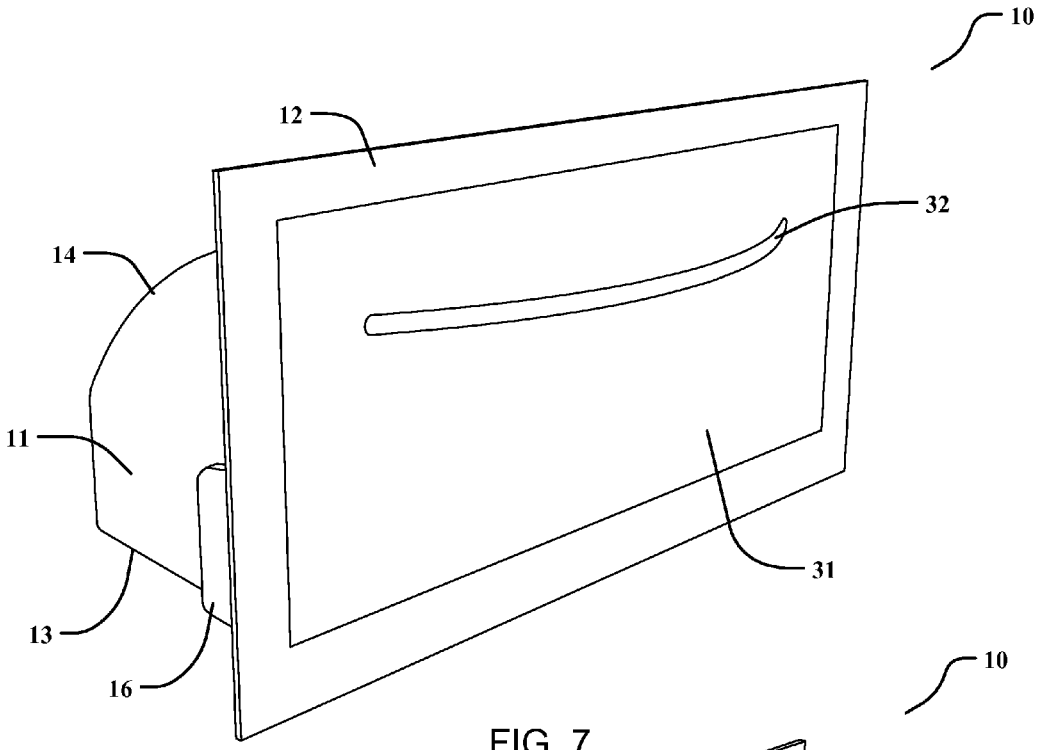
FIG. 7 is a perspective view of the recessed shower container in the closed position according to one embodiment of the invention.

FIG. 7 illustrates the storage compartment 10 assembled and in its closed position. The attached drawer 21 and front panel 31 are completely enclosed within the housing 11, the drawer 21 generally resting horizontally and the front panel 31 generally resting vertically. In the closed position, the top of the front panel 31 will rest on a rubber edge 15 of the housing 11, just below the flange 12 and immediately in front of the curved ceiling 14. The rubber edge 15 will operate as a means to absorb the impact when the drawer 21 and front panel 31 close, as well as a sealing means to prevent water from entering into the storage compartment 10.

Figure 8:
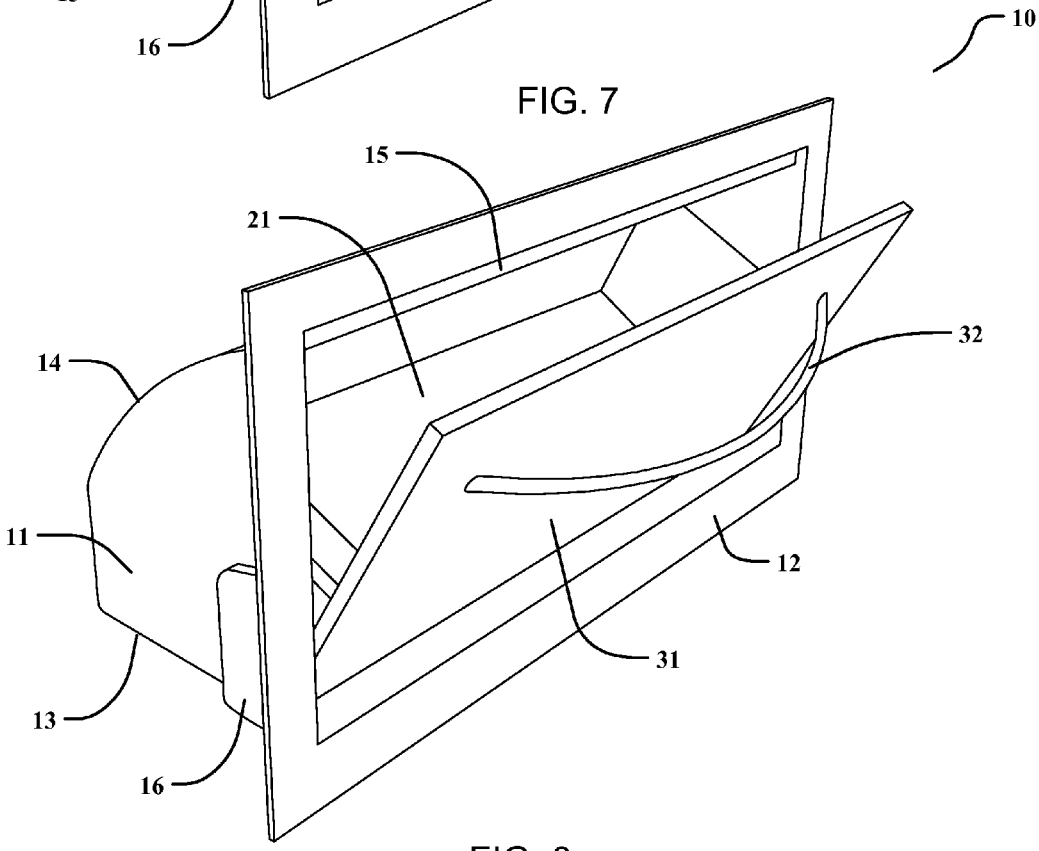
FIG. 8 is a perspective view of the recessed shower container in the open position according to one embodiment of the invention.

FIG. 8 illustrates the storage compartment 10 assembled and in its open position. Here, force has been applied outwardly on the handle 32 to rotate the drawer 21 and front panel 31 until the bottom of the front panel 31 comes in contact with the stopper 39. The drawer 21 and front panel 31 will open to a generally 45-degree angle from the housing floor, that angle dictated by the location of the stopper 39. The curved ceiling 14 of the housing 11 will allow the rear side 27 of the drawer 21 to rotate upward without interference. Furthermore, the outward protrusions 24 of the drawer 21 provide additional clearance between the side walls 35 of the housing 11 and the side walls 26 of the drawer 21. To return to the closed position from the open position, inward force needs to be applied to the handle 32 or top of the front panel 31.

In an alternative embodiment, the small shafts 25 are each surrounded by a torsion spring, with one end of the spring fixedly attached to the housing 11 and the other fixedly attached to the drawer 21. As such, when the drawer 21 and front panel 31 are rotated from the closed position to the open position, the torsion spring will store energy, and when the force is released, the stored energy will return the storage compartment 10 to its closed position. Alternatively, a tension spring will attach directly between the housing 11 and drawer 21 or front panel 31 to return an opened storage container 10 to its closed position.

In a further alternative embodiment, the present invention may have a means of securing the storage compartment 10 in its closed position by snapping the front panel 31 onto the rubber edge 15. In an even further alternative embodiment, a lock may be implemented to protect the contents of the storage container 10 from unwanted access. In still a further embodiment of the invention, the shaft 25 will dictate the range of motion of the storage compartment 10 by either limiting the rotation of the tension spring or with a small protrusion from the shaft body 25.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

What is claimed is:

1. A recessed storage compartment comprising:

a housing having a pair of opposing housing side walls, a housing rear wall, an open front, a housing floor sloping downward from the rear wall to the open front of the housing, a generally curved ceiling, and a housing flange surrounding the perimeter of the open front of the housing and extending outward, parallel to the housing rear wall;

a drawer having a pair of opposing drawer side walls, a drawer rear wall, an open top, an open front, a drawer floor sloping downward from the drawer rear wall to the open front of the drawer, and a drawer flange extending outward from the open side of the drawer side walls and drawer floor, parallel to the drawer rear wall;

a front panel having a fixedly attached handle;

an outward protrusion with beveled edges is formed on each drawer side wall which forms an indentation with said drawer flange in the shape of said outward protrusion;

a pair of small shafts which are fixedly attached to said outward protrusions; and a pair of opposing bores on each housing side wall;

wherein the front panel is fixedly attached to the drawer flange, creating a compartment, and wherein the drawer is completely enclosed within the housing.

2. The recessed storage compartment of claim 1, wherein the small shafts are pivotally connected to the bores, creating a bottom-hinged opening mechanism.

3. The recessed storage compartment of claim 2, the housing further comprising:

a rubber edge below the housing flange and in front of the curved ceiling; and a rubber stopper on the housing floor.

4. The recessed storage compartment of claim 3, further comprising a closed state, where the drawer is generally resting horizontally and the front panel is generally resting vertically and against the rubber edge.

5. The recessed storage compartment of claim 3, further comprising an open state, where the bottom of the front panel rests on the stopper and the drawer and front panel are generally at a 45-degree angle from the housing floor.

6. The recessed storage compartment of claim 1, wherein the housing is recessed within a shower wall having a cement board and a tile portion, the housing flange being positioned between the cement board and tile portion and the housing flange being fixedly attached to the cement board.

7. The recessed storage compartment of claim 1, the drawer floor further comprising apertures positioned at the lower side of the sloped drawer floor for draining excess water.

* * * * *